US006343550B1

(12) United States Patent
Feesler

(10) Patent No.: US 6,343,550 B1
(45) Date of Patent: Feb. 5, 2002

(54) FLEXOGRAPHIC PRINTING APPARATUS AND METHOD

(76) Inventor: Douglas W. Feesler, 110 Greenwich Rd. #21, Seville, OH (US) 44273

( * ) Notice: Subject to any disclaimer, the term of this patent is extended or adjusted under 35 U.S.C. 154(b) by 0 days.

(21) Appl. No.: 09/491,484

(22) Filed: Jan. 24, 2000

(51) Int. Cl.[7] ..... B41F 5/24; B41F 22/00

(52) U.S. Cl. ..... 101/376; 101/375; 101/494; 101/379; 101/483

(58) Field of Search ..... 101/407.1, 408, 101/409, 219, 375, 376, 480, 494, 228, 401, 379, 483

(56) References Cited

U.S. PATENT DOCUMENTS

| | | | | | |
|---|---|---|---|---|---|
| 3,247,403 | A | * | 4/1966 | Randazzo | 101/379 |
| 3,775,821 | A | | 12/1973 | Somerville | |
| 3,934,509 | A | * | 1/1976 | Saunders et al. | 101/415.1 |
| 4,871,631 | A | | 10/1989 | Pieper et al. | |
| 4,875,069 | A | | 10/1989 | Takada et al. | |
| 4,904,322 | A | * | 2/1990 | Mertens | 156/196 |
| 5,355,798 | A | * | 10/1994 | Yoder, Jr. | 101/247 |
| 5,562,039 | A | * | 10/1996 | Fox et al. | 101/415.1 |
| 5,617,786 | A | * | 4/1997 | Negishi | 101/116 |
| 5,792,262 | A | * | 8/1998 | Bohn et al. | 101/389.1 |

FOREIGN PATENT DOCUMENTS

JP 4-21442 A * 1/1992

OTHER PUBLICATIONS

The Arnold Engineering Co., Plastiform Flexible Bonded Magnets, Nov. 1998, Rev. A, p. 7.18.*

* cited by examiner

*Primary Examiner*—Daniel J. Colilla
(74) *Attorney, Agent, or Firm*—Daniel D. Wasil; Walker & Jocke

(57) ABSTRACT

A pull band (34) is attached to a printing plate (22) in a flexographic printing operation to hold a flexible substrate (30) in a selected orientation for transfer of ink in a selected pattern. The pull band overcomes differences in friction between the printing plate and the substrate in areas of different amounts of ink to maintain the selected orientation. A specific length pull band may be selected and cut from a roll of pull band material. Pull bands may be attached parallel and perpendicular to the direction of rotation of the printing plate.

17 Claims, 4 Drawing Sheets

FLEXOGRAPHIC PRINTING APPARATUS AND METHOD

TECHNICAL FIELD

This invention relates to flexographic printing. More specifically this invention relates to an apparatus and method for correcting or preventing the misalignment of a flexible substrate during flexographic printing.

BACKGROUND ART

Flexographic printing, also known as flexography, was developed primarily for printing flexible substrate packaging materials such as corrugated boxes, displays or inserts. As more and more products are being packaged, manufacturers are using flexography to meet their packaging and labeling requirements.

Flexography is a method of direct rotary printing that uses resilient relief image plates of rubber or photo polymer material. The plates are affixed to plate cylinders of various repeat lengths, inked by a cell-structured ink metering roll, with or without a doctor blade, and carry a fast drying fluid ink to plates that print onto virtually any substrate, absorbent or nonabsorbent. For every revolution of the printing plate cylinder, an image is produced.

The flexographic printing process uses an inking press system, a typical example of which is shown in FIG. 1. Briefly, an ink reservoir 12 supplies ink 14 to a rubber fountain roll 16 which in turn supplies ink 14 to a metering roll 18. Metering roll 18 is often an anilox roll which has cells mechanically or laser engraved into the face of the roll. Anilox ink metering roll 18 applies a measured amount of ink 14 to the rotating printing plates 22 on the cylinder 24. The amount of ink 14 delivered to the plates 22 is metered by the screen size of the cells on the anilox roll.

In some systems on the surface of metering roll 18 is a reverse-angle doctor blade 20. If used, doctor blade 20 shears the ink 14 from the surface of the ink metering (anilox) roll 18 and transfers uniform levels of ink from cells in anilox roll 18 to the surface of printing plates 22 mounted to a printing plate cylinder 24. The system can also run without a doctor blade, and is then known as a two-roll flexographic inking system. In a two-roll system, ink fountain roll 16 is geared to run slower than metering roll 18 so that a wiping or roll-doctoring action takes place between rollers 16 and 18.

Flexographic printing plates 22 can be made of vulcanized rubber or a variety of ultraviolet-sensitive polymer resins. The plates 22 have a raised image and print directly to a flexible substrate 30 with a very light "kiss" impression. Flexographic plates 22 are resilient and displaceable. Plates 22 are generally attached or mounted to plate cylinders 24.

Plates 22 carry ink 14 to a flexible substrate 30 as it travels through the ink press system. An impression roll 26 supports flexible substrate 30 at the point ink is being applied. Flexography uses fluid inks that are traditionally of low viscosity, highly fluid and quick drying. The inks are made into a dispersion of resins, solvents, color and additives which are either solvent or water reducible. These dry very quickly between the print stations of a press.

Flexographic printing presses either print on a continuous web of printable material or are equipped with a sheeter that delivers sheets instead of wound rolls. For high-quality images, the smoother the substrate the better.

The vast number of substrates on which flexography can print is one of its greatest advantages. There are a number of other advantages of flexographic printing. It can print on a wide variety of absorbent and nonabsorbent substrates. It uses fast-drying inks. It can print wet ink over dry ink to eliminate trapping problems, back-trap contamination and set off. It uses resilient rubber or photo polymer image carriers that can print millions of impressions. Presses can accommodate a wide range of cylinder repeat lengths to match print length requirements. Flexography is a near total variable repeat length system. Press speeds of 2,000 feet per minute or more are possible.

The printing plate cylinders can be removed from the press and plates can be mounted on individual plate cylinders held in a mounting machine. In a pre-production operation, proofs of flexible substrate 30 can be pulled from each cylinder to verify color-to-color registration along with any other specifications that need to be checked before running the job.

Ink on a printing plate may not be uniformly distributed. The image to be printed may need more ink on one side or the other, or there may be a need for more ink at the top or bottom with relatively less ink in the mid-section of the plate. This difference in ink distribution causes the friction between the printing plate and the flexible substrate to be not uniform. Differences in friction between different locations of a flexible substrate may cause the flexible substrate to pull or shift. This causes a deterioration in the quality of the printed image.

To correct for pulling or shifting during ink transfer, pull bands have been used horizontally on the leading edge or the trail edge of premounted printing plates and also along the side edges to correct the pulling or shifting of flexible substrate by presenting a uniform surface friction so that the machine can better grab or grip the sheet as it is pulled between the printing plate cylinder and the impression roll of the machine.

Some flexible substrates, such as corrugated sheets, often do not remain flat as they travel through a press. They may curl as they pass between the printing plate cylinder and the impression roll. To correct for curling edges, pull bands have been used horizontally onto either the leading edge or the trail edge of premounted printing plates to correct the warping of flexible substrate by pressing down on the starting or leading edge of the flexible substrate as it enters the press feed rollers, so that the machine can better grab or grip the sheet as it is pulled into the feed end of the machine.

The pull bands may be attached, such as by mechanically attaching them, to the sides of printing plates or, alternatively, are connected to the pull rolls of a printing press or die cutter.

Pull bands have been made as hand cut pieces of premanufactured rubber stock or have been manufactured by use of a standard liquid or sheet polymer plate making process. The hand cut pull bands could be made to different lengths to accommodate flexible substrates of varying sizes, but required substantial skill in addition to time and effort. Manufactured pull bands have been made in a limited number of discrete lengths. These manufactured pull bands often need to be cut shorter, resulting in waste. A multiplicity of pull band sizes must be purchased and stored, resulting in higher cost and storage needs.

Furthermore, problems such as the slipping or twisting of sheets, especially corrugated sheets, still exists, even when using the prior art pull bands. The prior art pull bands often do not keep sheets flat as they are run through the press.

Thus there exists a need for an apparatus and method which may be used to keep flexible substrates of varying sizes aligned with a flexographic printing plate for proper ink transfer.

DISCLOSURE OF INVENTION

It is an object of the present invention to provide an apparatus and method which keeps flexible substrates aligned as they travel through a press or die cutter.

It is a further object of the present invention to provide an apparatus and method which keeps flexible substrates aligned as they travel through a press or die cutter and which can be added to one or two sides of a premounted set of printing plates.

It is a further object of the present invention to provide an apparatus and method which keeps flexible substrates aligned as they travel through a press or die cutter and which can be added directly onto the pull rolls of a printing press or die cutter.

It is a further object of the present invention to provide an apparatus and method which keeps flexible substrates aligned as they travel through a press or die cutter and which may be used horizontally on the leading edge and/or the trailing edge of premounted printing plates to correct the warping of flexible substrates.

It is a further object of the present invention to provide an apparatus and method which can be used to keep flexible substrates aligned and can be used for varying sizes of flexible substrates.

The foregoing objects are accomplished in a preferred embodiment of the invention by an apparatus and method for pull bands which are connected to the printing plates or alternatively are connected to the pull rolls of a printing press or die cutter.

Further objects of the present invention will be made apparent in the following Best Mode For Carrying Out Invention and the appended claims.

BEST MODE FOR CARRYING OUT INVENTION

Figure 2:
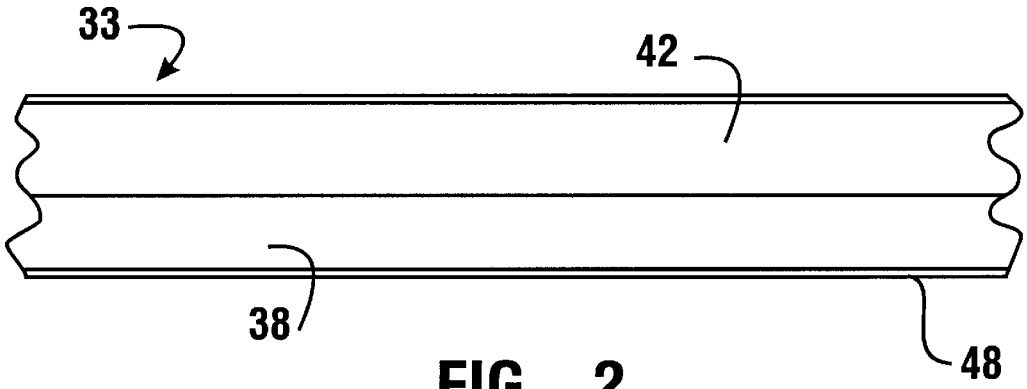
FIG. 2 is a length of a side view of a pull band of the present invention.
Figure 3:
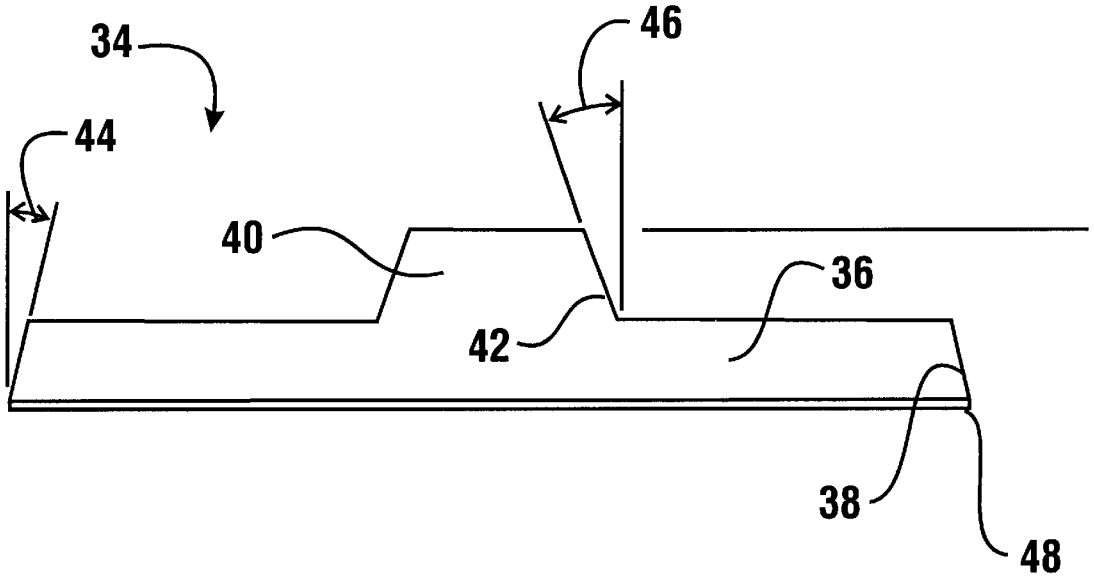
FIG. 3 is a cross sectional view of a pull band of the present invention.

A segmental length of a pull band 34 is shown in FIGS. 2 and 3. In an exemplary embodiment of the invention any length of pull band stock 33 may be extruded from Buna-n rubber, EPDM or an ethylene propylene polymer. The pull band stock 33 ideally has approximately a 55 durometer hardness. Pull band stock 33 may be coiled or wrapped on a spool or other form for storage until needed. This arrangement enables obtaining a pull band from a continuous pull band stock located on a roll. A pull band 34 can be cut to any selected or predetermined length as necessary or desired with a knife or scissors or other cutting instrument from pull band stock 33. The pull band 34 may be cut directly from the pull band stock 33. Thus a pull band of proper length may be obtained without any waste.

Pull band 34 has two integrally formed portions, a base 36 and a ridge 40. Base 36 in the exemplary embodiment is trapezoidal in shape with base edges 38 sloped inwardly toward each other at angles 44. Ridge 40 is trapezoidal in shape with ridge edges 42 sloped inwardly toward each other at angles 46. In exemplary embodiments of the invention the angles 44 may range from 5° to 15°, and the angles 46 may range from 10° to 30°.

The pull bands of the present invention have many additional advantages over the prior art pull bands. The uppermost portion of ridge 40 provides a wide contact surface for gripping a sheet. The angled ridge edges 42 and base edges 38 provide for increased strength and stability. The angled edges 42 of the ridge 40 reduces the amount of material at the top of the ridge 40. This arrangement reduces movement and wobbling of the top of the ridge 40, thereby increasing the stability of the ridge 40 and the pull band 34. The angled edges 38 of the base 36 provide a likewise advantage in increased stability. Furthermore, the angles 46, 44 of the respective ridge edges 42 and base edges 38 help prevent the substrate 30 from catching or snagging the pull band 34. Also, the width of the base 36 provides for an increased adhesion area.

In a preferred embodiment the width of base 36 is approximately 13⁄8 inches and angles 44 are approximately 10° from a direction perpendicular to base 36. The width of the uppermost portion of ridge 40 is approximately ¼ inch and angles 46 are approximately 20° from a direction perpendicular to ridge 40. The thickness of base 36 and ridge 40 are each approximately ⅛ inch, giving pull band 34 a maximum thickness of approximately ¼ inch. The widths and thicknesses of base 36 and ridge 40 as well as angles 44 and 46 may be larger or smaller as needed for various flexographic presses.

The pull bands may comprise a self-adhesive backing 48. Adhesive backing 48 permits adhering pull bands 34 to any location required on a printing plate or a pull roll. An adhesive backing of a pull band permits adhering the pull band to an exterior surface of the printing plate. The pull band stock may have an adhesive backing covered with a peel-off paper. The peel-off paper may be easily removed to expose the adhesive backing 48. The adhesive backing provides for a secure attachment of a pull band to a printing plate or a pull roll. Thus an attached pull band is operative to grip a flexible substrate to maintain a preselected relationship between the plate and the substrate.

Figure 1:
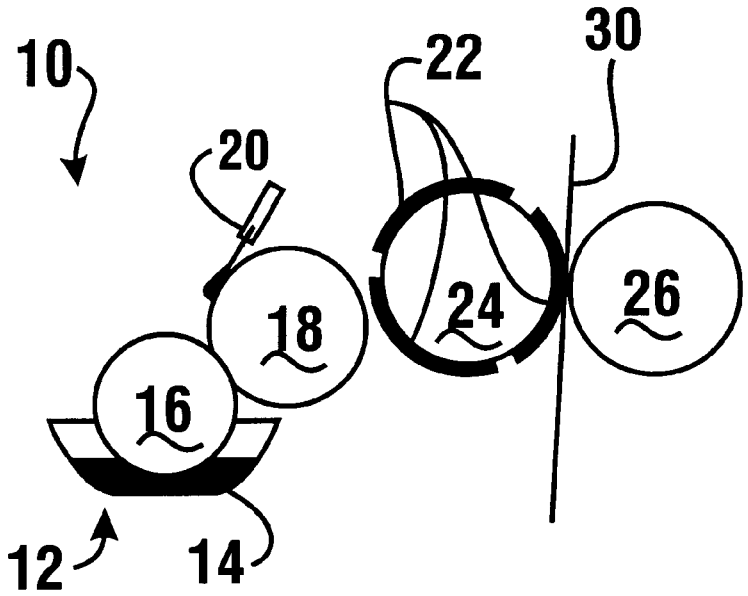
FIG. 1 Prior Art
FIG. 1 is a schematic diagram of a flexographic inking press system.
Figure 5:
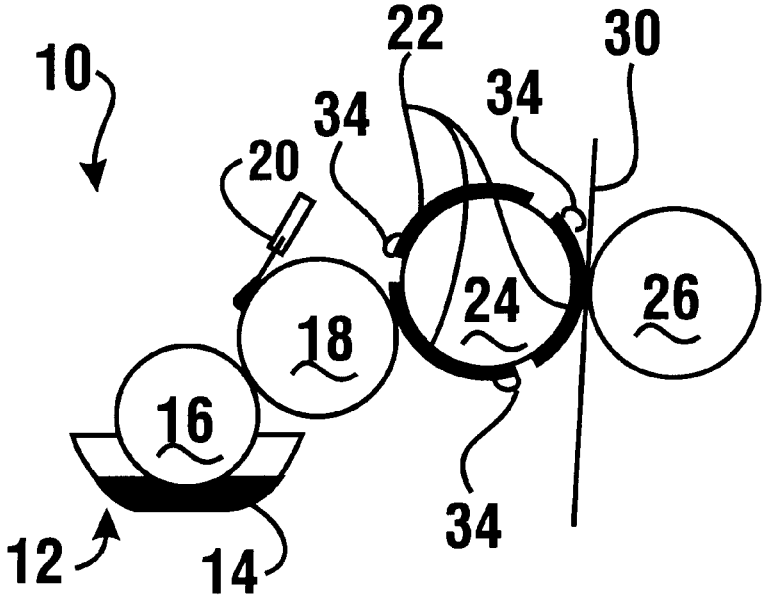
FIG. 5 is a schematic diagram of a flexographic inking press system using a pull band of the present invention positioned along the leading edge of printing plates.
Figure 4:
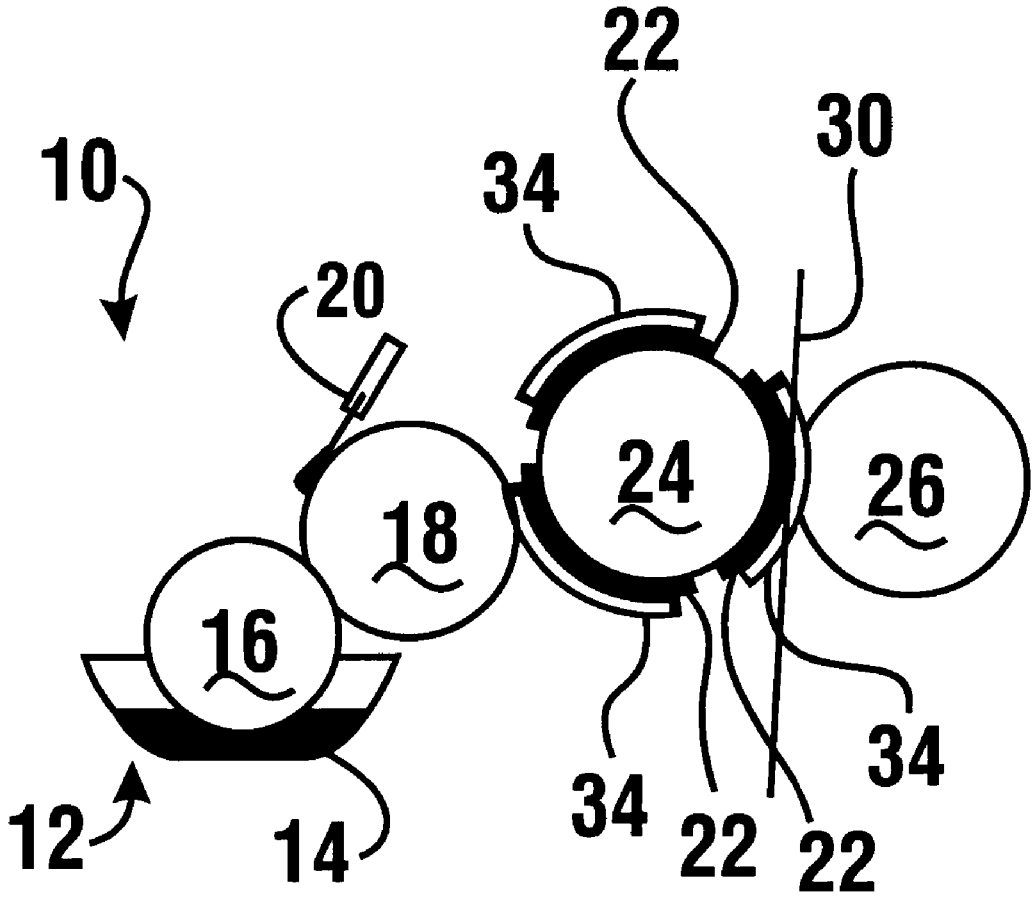
FIG. 4 is a schematic diagram of a flexographic inking press system using a pull band of the present invention positioned along the side edge of printing plates.

The pull bands 34 in an exemplary embodiment of the invention are shown in place on printing plates 22 in FIGS. 4 and 5. However, one or more pull bands may be located on a pull roll or impression roll 26. FIG. 4 is a schematic diagram of a flexographic inking press system using a pull band of the present invention positioned along the side edge of printing plates. Pull bands 34 may be placed to press down on one or more side edges of the flexible substrate 30.

FIG. 5 is a is a schematic diagram of a flexographic inking press system using a pull band of the present invention positioned along the leading edge of printing plates. Pull bands 34 may be placed to press down on the starting or leading edge of flexible substrate 30 as it enters the press 10 so that the machine can better grab or grip the flexible substrate as it is pulled into the feed end of the machine.

In the embodiments of the invention one or more pull bands 34 may be placed parallel and/or perpendicular to the direction of flexible substrate 30 movement. Also, back-to-back pulls bands or spaced pull bands may be used in place of a single continuous pull band.

Figure 6:
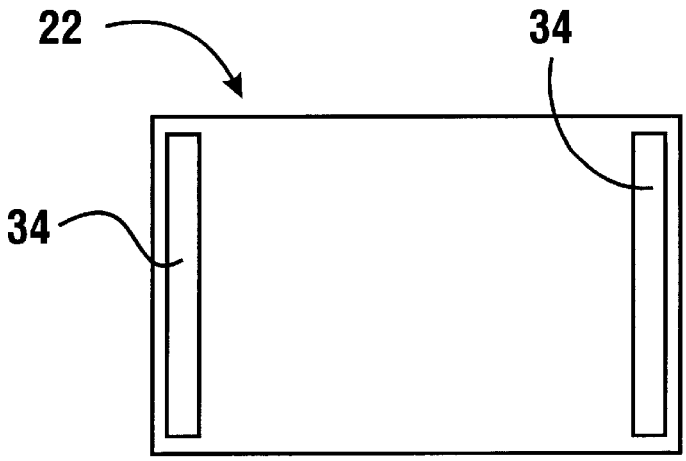
FIG. 6 shows pull bands of the present invention positioned along side edges of a printing plate.
Figure 7:
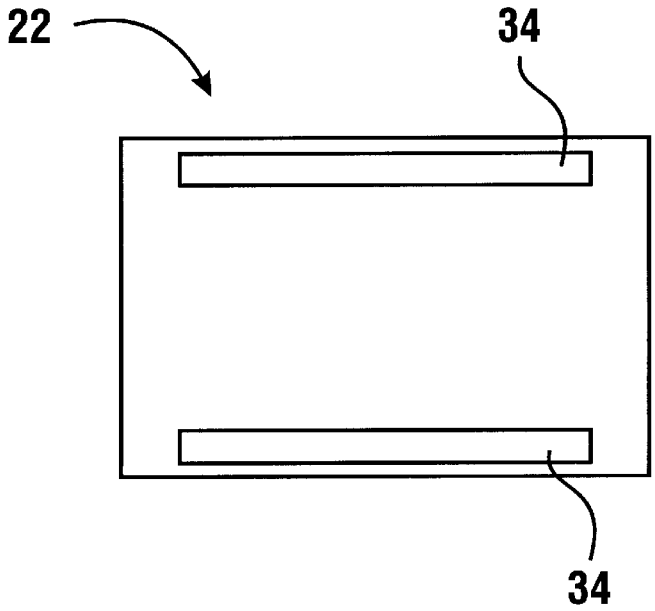
FIG. 7 shows pull bands of the present invention positioned along horizontal edges of a printing plate.
Figure 8:
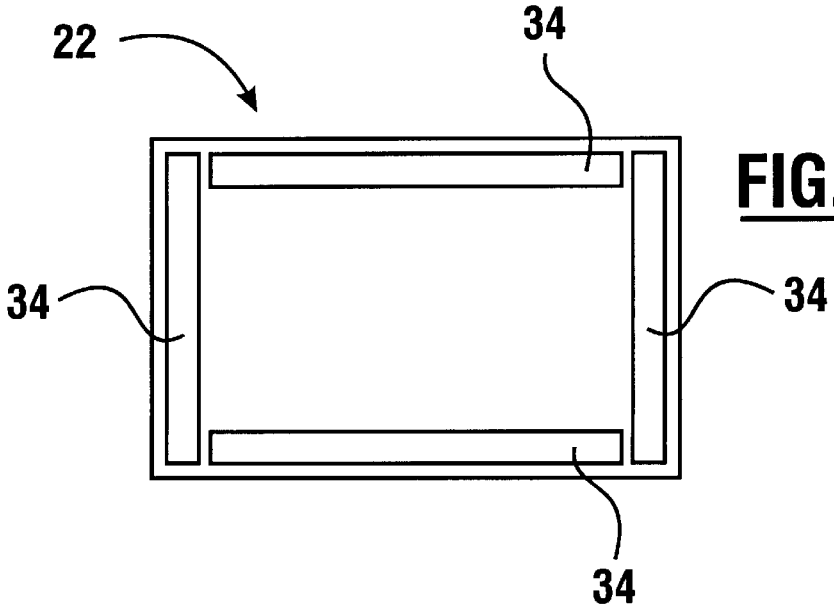
FIG. 8 shows pull bands of the present invention positioned along horizontal edges and side edges of a printing plate.

FIGS. 6, 7, and 8 show some of the many arrangements in which pull bands may be positioned on a printing plate. FIG. 6 shows pull bands 34 positioned along side edges of a printing plate 22. FIG. 7 shows pull bands 34 positioned along horizontal edges of a printing plate 22. The horizontal edges being perpendicular to the direction of flexible substrate 30 movement. The pull bands may be positioned horizontally along leading and/or trailing edges of a printing plate. FIG. 8 shows pull bands 34 positioned along horizontal edges and side edges of a printing plate 22.

Attaching one or more pull bands 34, after being cut to a selected or predetermined length from a roll or coil of pull band stock 33, to a printing plate 22 provides a method for controlling the alignment of a flexible substrate 30 during application of ink to the flexible substrate.

Thus the new pull band apparatus and method of the present invention achieves the above stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function, and shall not be limited to the structures shown herein or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

I claim:

1. A flexographic printing apparatus for controlling the orientation of a flexible substrate during application of ink to the flexible substrate, the apparatus comprising:

a pull band, wherein the pull band comprises an elastomeric material, wherein the pull band comprises a self-adhesive backing, and wherein the self-adhesive backing permits adhering the pull band to a printing plate, wherein the pull band comprises a base and a ridge, wherein the base is trapezoidal in shape with base edges sloped toward each other at angles, and wherein the ridge is trapezoidal in shape with ridge edges sloped toward each other at angles.

2. The flexographic printing apparatus of claim 1 wherein the elastomeric material is Buna'n rubber, and wherein the pull band has about a 55 durometer hardness.

3. The flexographic printing apparatus of claim 1 further comprising a plurality of pull bands operative to grip a plurality of edges of the flexible substrate.

4. The flexographic printing apparatus of claim 1 wherein the angles of the base edges are approximately 10 degrees, and wherein the angles of the ridge edges are approximately 20 degrees.

5. The flexographic printing apparatus of claim 4 wherein the width of the base is approximately 1⅜ inches, wherein the width of the ridge is approximately ¼ inch, and wherein the thickness of the base and the ridge are each approximately ⅛ inch.

6. A method for controlling the orientation of a flexible substrate during application of ink to the flexible substrate in a flexographic printing operation, the ink being supplied from an ink reservoir, a printing plate being rotatable wherein the ink releasably adheres to the printing plate, wherein the flexible substrate is caused to move in contact with the printing plate, wherein ink is transferred from the printing plate to the flexible substrate, the method comprising:

attaching a pull band to the flexographic printing plate, wherein the pull band comprises an elastomeric material, wherein prior to the attaching step, the pull band is cut to a selected length from a roll of pull band stock;

gripping the flexible substrate with the pull band to maintain a preselected relationship between the flexographic printing plate and the flexible substrate; and applying ink from the flexographic printing plate to the flexible substrate.

7. The method of claim 6 wherein the pull band stock comprises a self-adhesive backing, and wherein the attaching step comprises adhering the pull band to the printing plate using the self-adhesive backing.

8. The method of claim 7 wherein the pull band comprises a base and a ridge, wherein the base is trapezoidal in shape with base edges sloped toward each other at angles, and wherein the ridge is trapezoidal in shape with ridge edges sloped toward each other at angles.

9. The method of claim 8 wherein the angles of the base edges are approximately 10degrees, and wherein the angles of the ridge edges are approximately 20 degrees.

10. The method of claim 7 wherein the attaching step comprises attaching a plurality of pull bands to the printing plate operative to grip a plurality of edges of the flexible substrate.

11. A flexographic printing apparatus for controlling the orientation of a flexible substrate during application of ink to the flexible substrate, the apparatus comprising:

a flexographic printing plate;

a pull band, wherein the pull band is operative to grip the flexible substrate to maintain a preselected relationship between the flexographic printing plate and the flexible substrate, wherein the pull band comprises an elastomeric material, wherein the pull band comprises a self-adhesive backing, wherein the self-adhesive backing adheres the pull band to the printing plate in attached connection, wherein the pull band comprises a base and a ridge, wherein the base is trapezoidal in shape with base edges sloped toward each other at angles, and wherein the ridge is trapezoidal in shape with ridge edges sloped toward each other at angles.

12. The flexographic printing apparatus of claim 11 wherein the attached pull band is operative to grip an edge of the flexible substrate, the edge being parallel to the direction the flexible substrate moves in rollable contact with the printing plate.

13. The flexographic printing apparatus of claim 11 wherein the attached pull band is operative to grip an edge of the flexible substrate, the edge being perpendicular to the direction the flexible substrate moves in rollable contact with the printing plate.

14. The flexographic printing apparatus of claim 11 wherein a plurality of pull bands are in attached connection with the printing plate operative to grip a plurality of edges of the flexible substrate.

15. The flexographic printing apparatus of claim 11 wherein the angles of the base edges are approximately 10 degrees, and wherein the angles of the ridge edges are approximately 20 degrees.

16. A flexographic printing apparatus for use in controlling the orientation of a flexible substrate during application of ink to the flexible substrate, the apparatus comprising:

a continuous pull band stock provided in a roll arrangement, wherein the pull band stock comprises an elastomeric material, wherein the pull band stock comprises a base and a ridge, wherein the pull band stock comprises a self-adhesive backing covered with peel-off paper, wherein the self-adhesive backing permits adhering the pull band to a printing plate.

17. The flexographic printing apparatus of claim 16 wherein the base is trapezoidal in shape with base edges sloped toward each other at angles, and wherein the ridge is trapezoidal in shape with ridge edges sloped toward each other at angles.

* * * * *